US005265166A

United States Patent [19]

Madnick et al.

[11] Patent Number: 5,265,166

[45] Date of Patent: Nov. 23, 1993

[54] MULTI-CHANNEL SOUND SIMULATION SYSTEM

[75] Inventors: Peter Madnick, Thousand Oaks, Calif.; Robert Rapoport, St. Petersburg, Fla.

[73] Assignee: Panor Corp., Hauppauge, N.Y.

[21] Appl. No.: 784,176

[22] Filed: Oct. 30, 1991

[51] Int. Cl.[5] ..... H04R 5/00

[52] U.S. Cl. ..... 381/27; 381/1; 381/18; 381/24

[58] Field of Search ..... 381/1, 18, 24, 27

[56] References Cited

U.S. PATENT DOCUMENTS

| | | | |
|---|---|---|---|
| 4,382,157 | 5/1983 | Wert, Jr. | 381/24 |
| 4,408,095 | 10/1983 | Ariga et al. | 381/24 |
| 4,586,192 | 4/1986 | Arntson | 381/1 |
| 4,771,466 | 9/1988 | Modafferi | 381/99 |
| 4,953,213 | 8/1990 | Tasaki et al. | 381/24 |

*Primary Examiner*—John K. Peng
*Assistant Examiner*—Edward Lefkowitz
*Attorney, Agent, or Firm*—Blum Kaplan

[57] ABSTRACT

A multi-channel sound simulation system for processing a stereophonic signal having a high frequency component for use with at least a pair of primary loudspeakers and a pair of secondary loudspeakers includes a receiving member for receiving the stereophonic signal and for producing a first primary channel signal and a second primary channel signal. The first and second primary channel signals are adapted to be respectively applied to a first primary loudspeaker and a second primary loudspeaker. The receiving member is further adapted to divide the input signal into a first secondary channel signal and a second secondary channel signal. The first and second secondary channel signals are fed through a roll-off member which inhibits the high frequency component of the signal, thereby producing inhibited first and second secondary channel signals. These inhibited signals are adapted to be respectively applied to the first and second secondary loudspeakers to supply ambiance information to a listener in a home audio/video system. The listener thus receives a fuller, more realistic sound in his/her own home.

15 Claims, 2 Drawing Sheets

MULTI-CHANNEL SOUND SIMULATION SYSTEM

BACKGROUND OF THE INVENTION

This invention is directed to a sound simulation system, and, in particular, to a multi-channel sound simulation system for interfacing between a stereo signal source and a plurality of loudspeakers for processing a stereophonic signal to be applied to a pair of primary and at least a pair of secondary loudspeakers in a home stereo system. This invention serves to provide a sense of surround sound ambiance in a listening room.

The development of the surround sound system commonly sold under the trademark DOLBY ®, by Dolby Laboratories, Inc. of San Francisco, Ca., for the motion picture and music industries has created a need for new systems to decode the DOLBY ® encoded sound. The DOLBY ® system involves a two-step procedure in which the original recording is encoded to combine multiple channels of information into two recorded channels. This encoding involves the mathematical manipulation of both the phase and frequency characteristics of the original sound. The resulting two-channel information is then recorded in the usual manner onto tapes, discs or the like. Upon playback, the DOLBY ® system decoder mathematically reconstructs the original multiple channel signals from the two-channel source. Heretofore, implementation of the DOLBY ® system required a minimum of four channels of amplification to accomplish this task. Accordingly, precise reconstruction of the multiple channels of information was complicated and required expensive electronic equipment capable of creating four distinct channel signals.

One such attempt at producing at least a four channel output from a stereophonic input is U.S. Pat. No. 3,697,692 (Hafler). The Hafler patent discloses a system for interfacing between a two-channel stereo signal and at least four loudspeakers for producing four output signals to be input into four loudspeakers, such that when the four loudspeakers are placed at the corners of a quadrilateral area, and are positioned to face toward the interior of the area, a listener positioned interior of the area perceives the sound to be directed from the four sides of the area, rather than from the four corners where the loudspeakers are located.

However, one disadvantage of systems such as Hafler is that the secondary speakers are often directly perceived by the listener. Thus, the listener receives a distinct perception of the presence of secondary speakers. Secondly, DOLBY ® encoded sound sources will often appear "bright", possessing too much high-frequency response, to listeners who do not have the actual DOLBY ® licensed equipment for its decoding. Thirdly, information which should "appear" localized front and center is often improperly positioned. Accordingly, reduction in the "brightness" of the DOLBY ® encoded source and the perception of the presence of separate secondary and/or tertiary loudspeakers is desired, as well as a method for improving the center image reproduction.

SUMMARY OF THE INVENTION

Generally speaking, in accordance with the present invention, a multi-channel sound simulation system for processing a stereophonic signal, having a high frequency component for use with at least a pair of primary loudspeakers and at least a pair of secondary loudspeakers, is provided. The sound simulation system includes an interfacing component for receiving the standard stereophonic signal and for producing a first primary channel signal and a second primary channel signal to be applied to first and second primary loudspeakers, respectively. The interfacing component includes an inhibit circuit for receiving said stereophonic signal and for producing a first secondary channel signal and a second secondary channel signal in which the high frequency component of the channel signals are reduced. The inhibited secondary channel signals are adapted to be applied to the secondary loudspeakers so that the listener perceives a fuller, more spacious sound.

In a preferred embodiment of the instant invention, a tertiary loudspeaker is utilized. The primary signals are combined and inhibited and applied to the tertiary loudspeaker to simulate center image localization without the perception of the presence of a distinct center speaker.

Accordingly, it is an object of this invention to provide an improved multi-channel sound simulation system.

Another object of this invention is to provide a sound simulation system wherein sound emanating from the secondary loudspeakers is less likely to be perceived by the listener as being distinct from the primary loudspeakers.

Still another object of this invention is to provide an improved sound simulation system where the sound is fuller and more spacious and does not require complex circuitry to achieve this result.

Still a further object of this invention is to provide a sound simulation system that minimizes instability in sound produced by the loudspeakers when fed through the stereo system.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which.

DESCRIPTION OF THE PREFERRED EMBODIMENT

Figure 1:
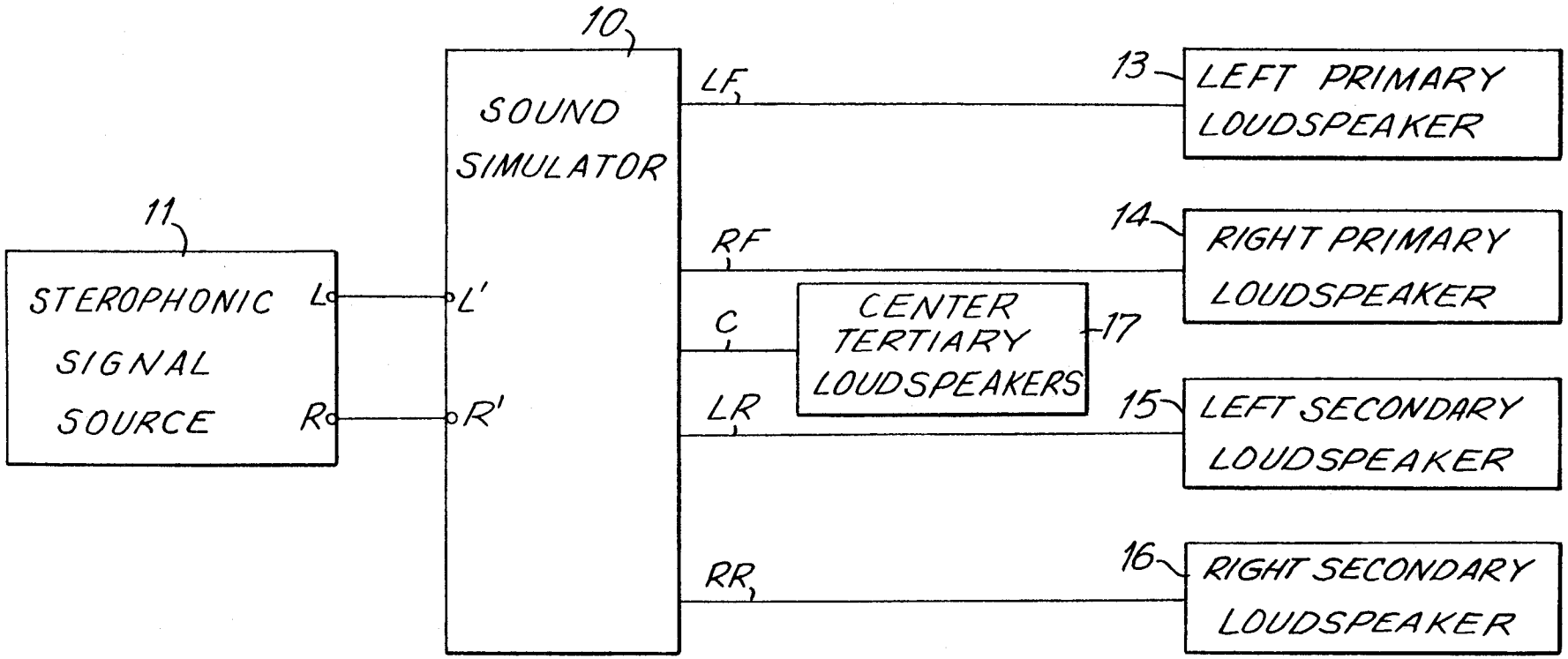
FIG. 1 is a block diagram of a multi-channel sound simulation system including the present invention.
Figure 2:
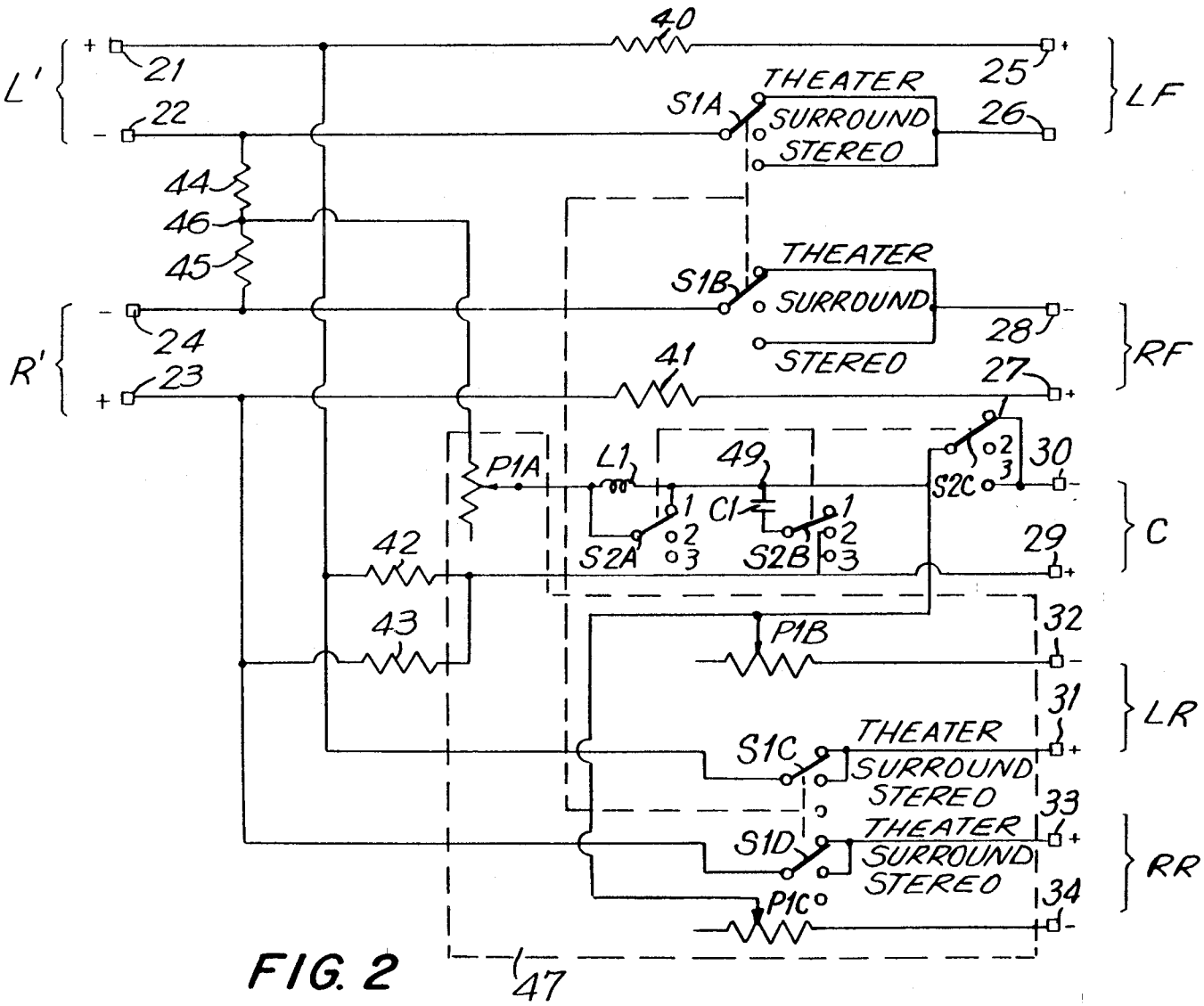
FIG. 2 is a schematic diagram of a preferred embodiment of the multi-channel sound simulation system constructed in accordance with the present invention.

Reference is made to FIGS. 1 and 2, wherein a multi-channel sound simulation system, in accordance with the present invention, is depicted. With reference to FIG. 1, a sound simulator generally indicated as 10, has left and right channel input terminals L' and R', respectively, for receiving a stereophonic signal from left and right terminals L and R of a stereophonic signal source, generally indicated as 11. Stereophonic signal source can be a home stereo receiver, amplifier or the like. Sound simulator 10 is adapted to apply right and left primary channel signals LF and RF, respectively, to Left Primary Loudspeaker 13 and Right Primary Loudspeaker 14. The pair of secondary channel signals LR and RR are modified to eliminate the high-frequency component thereof and to contain ambiance information and are then applied to Left Secondary Loudspeaker 15 and Right Secondary Loudspeaker 16. Sound simulator 10 is also adapted to combine the left stereo signal and right stereo signal and modify the same to supply a center channel signal C to a center loudspeaker 17 to provide center image localization in a manner to be discussed more specifically below.

Particular reference is now made to FIG. 2, wherein a schematic diagram of a preferred embodiment of the sound simulator 10 is depicted. A stereophonic input L' is received into left input terminals 21 and 22 and a right stereophonic input R' is received by the right input terminals 23 and 24. The left input terminal, also known as the left channel, has a positive component traveling along positive lead 21 and a negative component traveling across negative lead 22. Further, the right input terminal or right channel has a positive component traveling along positive lead 23 and a negative component traveling along negative lead 24.

The signal input into left input L is directly output to the left front output LF. Specifically, a first destabilizer resistor 40 is positioned intermediate input terminal 21 and output terminal 25. Accordingly, the current passing through and the voltage drop across the loudspeaker connected to channel LF is reduced. Thus, resistor 40 reduces the tendency of the dividing circuit to cause instability in the connected amplifier when connected to the Left Primary Loudspeaker.

As illustrated in FIG. 2, the sound simulator is disposed in a "theater mode" so that gang switches S1A, S1B, S1C and S1D (hereinafter collectively referred to as SWITCH S1) are each disposed in a "theater" position. Accordingly, the negative component of the left primary signal L' applied at input terminal 22 is applied through switch S1A to output terminal 26 and is applied to a left primary channel loudspeaker as the negative component of signal LF.

A resistor 41 is placed intermediate input terminal 23 and output terminal 27 to serve a similar stabilizing function to resistor 40. Resistors 40 and 41 can range in value between one (1) ohm and four (4) ohms. However, in a preferred embodiment resistors 40 and 41 equal 2.2 ohms. These preferred values may change as the power supplied by the amplifier of the system changes and as the resistance of the speakers changes. The resistance value of 2.2 ohms performs well with a large variety of amplifiers and speakers and, specifically, works well with "normal" home speakers having a resistance value of four (4) ohms. Furthermore, resistors 40 and 41 are provided to maintain a minimum amount of load, such that the amplifier feeding the sound signal into the input terminals is minimally loaded.

Resistors 40 and 41 are further provided to reduce the signal input into the primary loudspeakers from the front primary output terminals LF and RF, thereby decreasing the volume of sound output by the primary loudspeakers. This is preferred because the signals provided to the secondary loudspeakers have a high-frequency component removed therefrom and accordingly do not produce as high an apparent volume of sound as do the primary loudspeakers.

With respect to the center output signal C, substantial modification is performed to the signals between input terminals 21, 22, 23 and 24 and output terminals 29 and 30. Positive terminal 29 of center output C receives a combination of the signal received at positive terminal 21 and positive terminal 23. These signals are fed through resistors 42 and 43, respectively, and are joined at node 48. Signals occurring at node 48 are now a sum of those appearing at positive terminals 21 and 23. This monocombination of signals is output to positive terminal 29. Resistors 42 and 43 can range in value from between less than 10 ohms to greater than 40 ohms. However, in the preferred embodiment, resistors 42 and 43 are 20 ohms. Resistors 42 and 43 can be varied to effect the stereo separation between LF and RF.

The negative input terminals 22 and 24 are connected through resistors 44 and 45 which are in turn coupled to a single node 46. Resistors 44 and 45 may vary in a range from between less than 5 ohms to greater than 20 ohms. However, in a preferred embodiment, resistors 44 and 45 are 10 ohms. Resistors 44 and 45 provide an electrical sum of the negative polarity signals appearing at terminals 22 and 24. The arrangement of node 46 and loudspeakers LR and RR produce out of phase information signals providing the ambient channel simulation. Node 46 is electrically coupled to a first potentiometer P1A. Potentiometer P1, generally indicated in dashed lines as 47, is a gang potentiometer including P1A, P1B and P1C. As potentiometer P1A is varied, the amplitude of the signal passing therethrough varies and the volume of a loudspeaker connected to center output C varies accordingly. Potentiometer P1A is also electrically coupled to an inductor L1. Inductor L1 functions to remove a portion of the high frequency component of the signal. Inductor L1 may vary between less than 0.28 MH and greater than 1.2 MH. However, it is preferable to use an inductor of 0.56 MH. The other end of inductor L1 is electrically connected to a first side of capacitor C1. Capacitor C1 is provided to produce additional high frequency roll-off when combined with inductor L1. The other side of capacitor C1 is connected to one end of switch S2B.

Switch S2B is a three position gang switch which is connected to S2A and S2C (hereinafter referred to as SWITCH S2). When SWITCH S2 is in the first position, inductor L1 is short circuited and the second side of capacitor C1 is an open circuit. Accordingly, inductor L1 and capacitor C1 are effectively removed from the circuit when SWITCH S2 is in the first position. When SWITCH S2 is in the second and third positions, inductor L1 functions as an inductor because switch S2A is an open circuit and switch S2B electrically connects the second side of C1 to output terminal 29. Accordingly, capacitor C1 is in parallel with the load that is placed across center output C. Together capacitor C1 and induction L1 act to inhibit the high frequency component of the signal being connected to the load at an electrical rate of 12 dB per octave beginning at 5000 Hz.

When SWITCH S2 is in the second and third positions, the circuit operates as an RLC circuit which reduces the high frequency component of the input signal.

Switch S2C is a three pole switch in which positions 1 and 3 operate as a short circuit to output terminal 30 of center C. Position 2 of switch S2C operates as an open circuit such that no signal is transmitted to output terminal 30 of center C. Accordingly, when SWITCH S2 is in position 1, there is power applied to center speaker output C. However, there is no roll-off effect because inductor L1 is short circuited and the second side of capacitor C1 is an open circuit. Accordingly, a listener would not enjoy the reduced high frequency effect desired by the inventor. Further, when SWITCH S2 is in position 2, there is an open circuit and center C does not receive any power. Thus, a loudspeaker connected at center C would not be operational and the center image improvement would not be available. Ultimately, when SWITCH S2 is positioned in position 3, inductor L1 is operational, capacitor C1 is in parallel with the center output and the circuit is complete such that center output C receives power and the high frequencies are reduced.

With regard to the secondary outputs represented by output terminals 31, 32 and 33, 34, input terminals 21, 23 are connected to output terminals 31, 33 when SWITCH S1 is in theater mode or surround mode. However, when SWITCH S1 is in stereo mode, an open circuit is defined and the secondary outputs do not receive a signal. Furthermore, when switch S1 is in either the theater mode or the stereo mode, the primary output terminals 25, 26, 27 and 28 are operational. Alternatively, when SWITCH S1 is in surround mode, the primary output terminals are inactive. These additional modes are provided as an aid to the listener when initially setting up the multi-channel sound simulation system.

Potentiometer 47 is connected intermediate node 49 and output terminals 32, 34. The impedance of potentiometer 47 is added to the circuitry of the secondary channels in order to control the apparent volume of loudspeakers connected at LR and RR. Since potentiometer 47 is electrically coupled to node 49, the secondary channels obtain the desired roll off effect when SWITCH S2 is in its second and third position. This roll off effect was discussed hereinabove with respect to center output C.

Accordingly, the present invention provides a low cost means of producing desired results such as the inclusion of a fifth channel which may be provided at the center front of a home theater system. This center front channel is connected to the high frequency roll off circuit and provides a method of augmenting center image localization of a typical audio/video reproduction system. Thus, a complete system operating with five loudspeakers connected to the outputs of FIG. 2 would include primary speakers positioned in a right front and left front position and the secondary speakers positioned in a right rear and left rear position. The center front channel is intended to help the center image localization or, in the alternative, the prevention of the phenomenon of having a voice appear to come from some other part of the television screen when used in a video system, rather than from the actor (actress) who spoke it. This is accomplished while maintaining the "full" sound that is derived from at least two pairs of speakers.

Furthermore, the present invention incorporates the use of additional resistors to reduce any destabilizing effect of the increased number of speakers connected to two input channels. Many prior art sound systems attempting to accomplish the desired effect of this invention have suffered from instability when connected to some consumer amplifier systems. This is due to unknown amplifier capabilities and variations in loudspeaker characteristics. Accordingly, the present invention is capable of decoding stereophonic signals and producing multi-channel outputs inexpensively and with a minimum of external components.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A multi-channel sound simulation passive system for processing a stereophonic signal having a high frequency component for use with at least a pair of primary loudspeakers and a pair of secondary loudspeakers, comprising:

interfacing means for receiving a power amplified stereophonic signal and for producing a first primary channel signal a secondary primary channel signal, said first and second primary channel signals being adapted to be respectively applied without further amplification to a first primary loudspeaker and a second primary loudspeaker;

said interfacing means being further adapted to extract from said stereophonic signal a first secondary channel signal and a second secondary channel signal, and roll-off means for receiving said first secondary channel signal and said second secondary channel signal and for respectively inhibiting the high frequency component of said first and secondary channel signals to produce high frequency inhibited first and second secondary channel signals to be respectively applied without further amplification to a first secondary loudspeaker and a second secondary loudspeaker;

said interfacing means further producing a center tertiary channel signal to be applied without further amplification to a center loudspeaker to simulate a center image localization; and said center tertiary channel signal being produced by said roll-off means in response to said stereophonic signal which is inhibited by said roll-off means to produce a high frequency inhibited center tertiary channel signal so that there is no high frequency component in said high frequency inhibited center tertiary channel signal.

2. The multi-channel sound simulation passive system as claimed in claim 1, wherein said roll-off means includes an inductor circuit for inhibiting the high frequency component of the stereo signal.

3. The multi-channel sound simulation passive system as claimed in claim 2, wherein said inductor circuit is disposed in series with the first secondary loudspeaker.

4. The multi-channel sound simulation passive system as claimed in claim 1, wherein said roll-off means includes a capacitor circuit for inhibiting the high frequency component of the stereo signal.

5. The multi-channel sound simulation passive system as claimed in claim 4, wherein said capacitor circuit is disposed in parallel with the first secondary loudspeaker.

6. The multi-channel sound simulation passive system as claimed in claim 2, wherein said roll-off means includes a capacitor circuit for inhibiting the high frequency component of the stereo signal.

7. The multi-channel sound simulation passive system as claimed in claim 6, wherein the inductor circuit is disposed in series with the secondary loudspeakers and the capacitor circuit is disposed in parallel with the secondary loudspeakers.

8. The multi-channel sound simulation passive system as claimed in claim 1, further including stabilization means being electrically coupled to the first and second primary loudspeakers for stabilizing the signal being applied to said first and second primary loudspeakers.

9. The multi-channel sound simulation passive system as claimed in claim 8, wherein said stabilization means includes a resistor circuit disposed in series with the primary loudspeakers.

10. The multi-channel sound simulation passive system as claimed in claim 1, wherein said first and second primary loudspeakers and said first and second secondary loudspeakers are separated from each other relative to a listener positioned in an optional listening position.

11. The multi-channel sound simulation passive system as claimed in claim 1, wherein said center tertiary channel signal is for use with a center tertiary loudspeaker.

12. The multi-channel sound simulation passive system as claimed in claim 11, wherein said first and second primary loudspeakers and first and second secondary loudspeakers are separated from each other relative to a listener positioned in an optional position.

13. The multi-channel sound simulation passive system as claimed in claim 12, wherein said center tertiary loudspeaker is positioned intermediate said first and second primary loudspeakers.

14. The multi-channel sound simulation system as claimed in claim 2, wherein said inductor circuit is disposed in series with the second secondary loudspeaker.

15. The multi-channel sound simulation system as claimed in claim 4, wherein said capacitor circuit is disposed in parallel with the second secondary loudspeaker.

* * * * *